United States Patent [19]

Kiebala

[11] 4,117,461

[45] Sep. 26, 1978

[54] DIET CONTROL APPARATUS

[76] Inventor: Carol L. Kiebala, 1040 W. Partridge Dr., Palatine, Ill. 60067

[21] Appl. No.: 711,405

[22] Filed: Aug. 3, 1976

[51] Int. Cl.[2] ..... G08B 3/00; G08B 21/00

[52] U.S. Cl. ..... 340/545; 179/100.1 C; 340/666; 340/692

[58] Field of Search ..... 340/221, 272, 280, 421, 340/274 R; 35/29 R; 312/231; 179/100.1 C

[56] References Cited

U.S. PATENT DOCUMENTS

| | | | |
|---|---|---|---|
| 3,176,815 | 4/1965 | Farinola | 179/100.1 C |
| 3,609,250 | 9/1971 | Morris | 179/100.1 C |
| 3,689,909 | 9/1972 | Cotter | 340/272 |
| 3,938,120 | 2/1976 | O'Connell | 340/221 |
| 4,023,151 | 5/1977 | Markham | 340/272 |

*Primary Examiner*—Glen R. Swann, III

[57] ABSTRACT

Diet control apparatus comprises a food storage compartment having a door thereon for access to the compartment and broadcasting apparatus operatively connected to the compartment for broadcasting a message for encouraging dieting when food is sought in the compartment.

9 Claims, 3 Drawing Figures

DIET CONTROL APPARATUS

SUMMARY OF THE INVENTION

The present invention relates to diet control apparatus comprising a food storage compartment for storing foods, a door on the food storage compartment for providing access to and cutting off access from the interior of the storage compartment. Broadcasting apparatus is operatively connected to the food storage compartment for broadcasting a message for encouraging dieting when food is sought in the food storage compartment.

The broadcasting apparatus in one embodiment comprises a voice recording mechanism for broadcasting a recorded message therefrom for encouraging dieting when food is sought in the storage compartment.

The voice recording member in a further embodiment may comprise an electrically powered recording device and electrical switch apparatus operatively connected to the recording device for activating the recording device to broadcast a dieting message when food is sought in the food storage compartment.

The electrical switch may comprise a pressure sensitive switch operatively connected to a food shelf in the food storage compartment, the pressure sensitive switch electrically activating the voice recording apparatus to broadcast the dieting message when food is removed from the food shelf.

The voice recording member in a further embodiment may comprise a tape recording device operatively connected to a speaker, a power supply and the aforementioned pressure sensitive switch.

In one embodiment, the food storage compartment comprises a refrigerator box for the cold storage of food.

In yet another embodiment, the food shelf is mounted on a resilient device such as springs or a rubber member in the food storage compartment for resiliently biasing the food shelf to contact the pressure sensitive switch when food is positioned on the food shelf and to disengage the switch when food is removed from the food shelf, the pressure sensitive switch being closed when the food shelf disengages the pressure sensitive switch and open when the food shelf engages the pressure sensitive switch.

DETAILED DESCRIPTION

The prior art U.S. patents disclose various closure operated switch devices and include U.S. Pat. Nos. 3,698,352, Forman; 3,686,660, Massover, et al.; and 3,176,093, Pollak, et al. Additionally, the prior art discloses various recording devices in U.S. Pat. Nos. 3,769,744, Sloane, et al.; 3,636,655, Porter, et al.; 3,488,651, Brenner; 3,382,604, Ryan; and 3,234,687, Elwell.

None of the foregoing references disclose the use of a recording in a food storage compartment in which the recording device is operatively connected to the food storage compartment for broadcasting a message encouraging dieting when food is sought in the food storage compartment.

It is therefore an object of the present invention to overcome these and other difficulties encountered in the prior art.

It is a further object of the present invention to provide a diet control apparatus comprising a food storage compartment having a broadcasting device thereon operatively connected to the storage compartment for broadcasting a message for encouraging dieting when food is sought in the storage compartment.

These and other objects have been achieved according to the present invention and will become apparent from the disclosure and claims that follow as well as the appended drawing.

Figure 1:
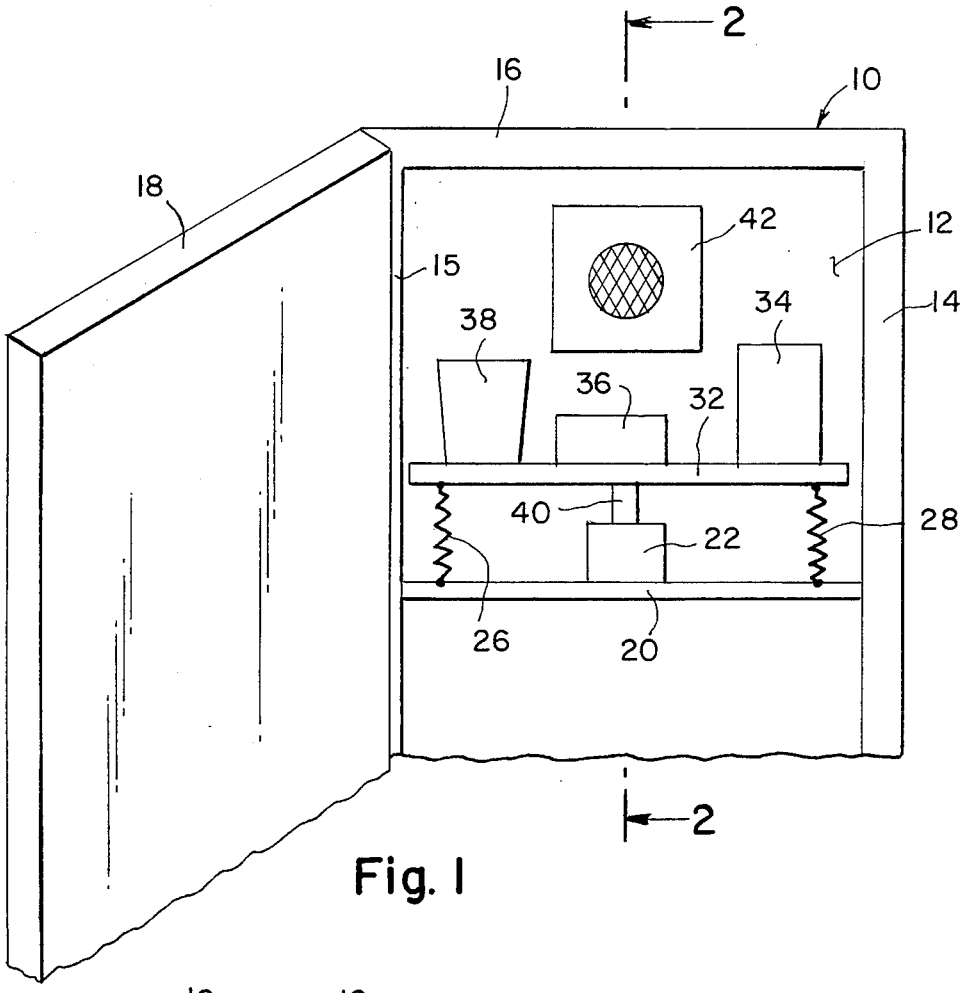
FIG. 1 is a partial perspective view of a diet control apparatus comprising a refrigerator box having a door and broadcasting apparatus comprising a shelf resiliently biased to activate a switch for turning on a voice recording machine for broadcasting a message encouraging dieting when food is sought in the refrigerator box according to one embodiment of the present invention.
Figure 2:
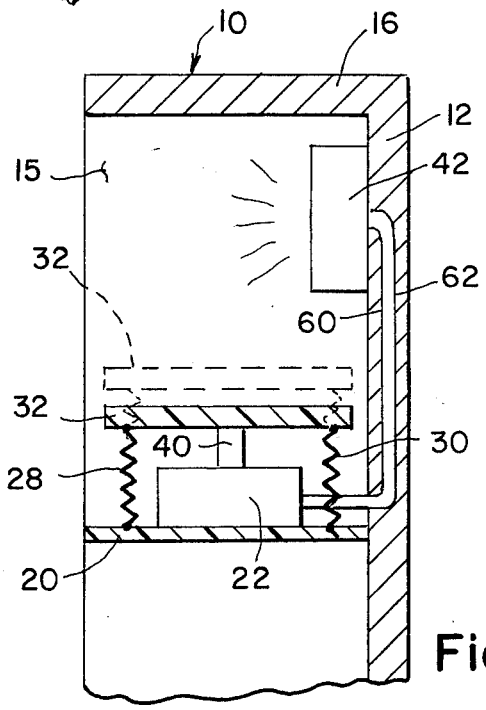
FIG. 2 comprises a side elevation in section and taken along the line 2—2 of FIG. 1.
Figure 3:
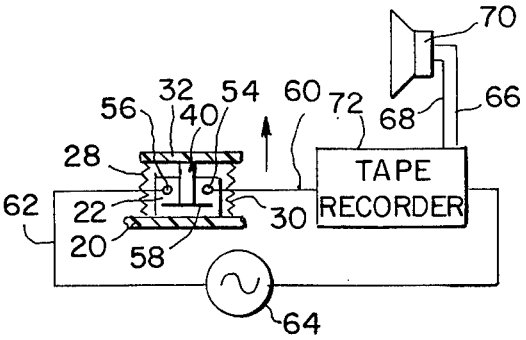
FIG. 3 comprises a schematic diagram of an electrically powered broadcasting device operatively connected to a shelf in a food storage compartment, the recording device being activated for broadcasting a message encouraging dieting when food is sought in the food storage device according to another embodiment of the present invention.

Referring to the drawing and FIGS. 1–3, a diet control apparatus 10 is illustrated comprising a food storage compartment having a top wall 16, side walls 14 and 15, a back wall 12 and a bottom wall (not illustrated) enclosed by a door 18 which is openable and closeable to provide access to the interior of the food storage box. A pressure sensitive switch 22 is mounted on a base 20 and supports a shelf 32 thereon by means of a post 40. Springs 26, 28 and 30 resiliently bias the shelf 32 in an upward direction, the weight of food in food packages 34, 36 and 38 forcing the shelf 32 in a downward direction so that the contacts 54 and 56 inside of the switch 22 are not connected with one another by means of switch bar 58. An electrically powered tape recorder 72 is operatively connected to a power supply 64 by means of electrical conduits 60 and 62, the output signal of tape recorder 72 being delivered to a speaker 70 by means of electrical wires 66 and 68. The tape recorder 72 and speaker 70 are contained in a recorder and speaker enclosure 42 mounted on wall 12 of the diet control apparatus 10.

In use, food items 34, 36 and 38 are placed on the shelf 32 to thereby disengage switch bar 58 from the contacts 54 and 56 and prevent electrical power from being received by the tape recorder 72 from power supply 64. Upon removal of the food items 34, 36 and 38, the shelf 32 is resiliently biased upwardly by means of the springs 28, 26 and 30 and the post 40 attached to shelf 32 brings the switch bar 58 into contact with the terminal posts 54 and 56 so that an electrical current is caused to flow through electrical wires 60 and 62 into tape recorder 72. A pre-recorded message is then automatically broadcast from tape recorder 72 through speaker 70 by means of electrical wire 68 and 66, the message encouraging dieting or some substitute activity in lieu of eating.

Although the invention has been described by reference to some embodiments, it is not intended that the novel diet control apparatus be limited thereby but that certain modifications thereof are intended to be included as falling within the broad spirit and scope of the foregoing disclosure, the following claims and the appended drawing.

What is claimed is:

1. Diet control apparatus comprising food storage compartment means for storing food, door means on said food storage compartment means for providing access and cutting off access to the interior of said food storage compartment means, broadcasting means for delivering a message for encouraging dieting operatively connected to said food storage compartment means, activating means to activate said broadcasting means to deliver a message for encouraging dieting when food is sought in said food storage compartment means.

2. The diet control apparatus of claim 1 where said broadcasting means comprising voice recording means for broadcasting a recorded message therefrom for encouraging dieting when food is sought in said food storage compartment means.

3. The diet control apparatus of claim 2 where said voice recording means comprises an electrically powered recording means, said activating means comprises electrical switch means operatively connected to said recording means for activating said recording means to broadcast a dieting message when food is sought in said food storage compartment means.

4. The diet control apparatus of claim 3 where said electrical switch means comprises a pressure sensitive switch operatively connected to food shelf means in said food storage compartment means, said pressure sensitive switch electrically activating said voice recording means to broadcast a dieting message when food is removed from said food shelf means to deplete said shelf below a predetermined weight.

5. The diet control apparatus of claim 4 where said voice recording means comprises tape recording means operatively connected to speaker means, a power supply and said pressure sensitive switch..

6. The diet control apparatus of claim 5 where said food storage compartment means comprises refrigerator box means for the cold storage of food.

7. The diet control apparatus of claim 4 where said food shelf means is mounted on resilient means in said food storage compartment means for resiliently biasing said food shelf to disengage said pressure sensitive switch when food is positioned on said food shelf and to engage said pressure sensitive switch when food is removed from said food shelf, said pressure sensitive switch being open when said food shelf disengages said pressure sensitive switch and said pressure sensitive switch being closed when said food shelf engages said pressure sensitive switch.

8. The diet control apparatus of claim 5 where said food shelf means is mounted on resilient means in said food storage compartment means for resiliently biasing said food shelf to disengage said pressure sensitive switch when food is positioned on said food shelf and to engage said pressure sensitive switch when food is removed from said food shelf, said pressure sensitive switch being open when said food shelf disengages said pressure sensitive switch and said pressure sensitive switch being closed when said food shelf engages said pressure sensitive switch.

9. The diet control apparatus of claim 6 where said food shelf means is mounted on resilient means in said food storage compartment means for resiliently biasing said food shelf to disengage said pressure sensitive switch when food is positioned on said food shelf and to engage said pressure sensitive switch when food is removed from said food shelf, said pressure sensitive switch being open when said food shelf disengages said pressure sensitive switch and said pressure sensitive switch being closed when said food shelf engages said pressure sensitive switch.

* * * * *